US005186633A

United States Patent [19]

Mosser, III

[11] Patent Number: 5,186,633

[45] Date of Patent: Feb. 16, 1993

[54] SURFACE MOUNT ELECTRICAL CONNECTOR WITH INTERLEAVED SOLDER TAILS

[75] Inventor: Benjamin H. Mosser, III, Middletown, Pa.

[73] Assignee: AMP Incorporated, Harrisburg, Pa.

[21] Appl. No.: 753,575

[22] Filed: Sep. 3, 1991

[51] Int. Cl.[5] ..... H01R 9/09

[52] U.S. Cl. ..... 439/79; 439/83

[58] Field of Search ..... 439/79-81, 439/83, 444, 830, 876

[56] References Cited

U.S. PATENT DOCUMENTS

| | | | |
|---|---|---|---|
| 3,573,704 | 4/1971 | Tarver | 339/14 |
| 3,676,746 | 7/1972 | Kassabgi et al. | 317/101 CC |
| 4,583,807 | 4/1986 | Kaufman et al. | 439/83 |
| 4,660,991 | 4/1987 | Simon | 368/10 |
| 4,756,696 | 7/1988 | Whitman, Jr. | 439/79 |
| 4,776,651 | 10/1988 | Paulo | 439/857 |
| 4,776,804 | 10/1988 | Johnson et al. | 439/62 |
| 4,802,860 | 2/1989 | Kikuta | 439/79 |
| 4,820,173 | 4/1989 | Thom et al. | 439/79 |
| 4,842,528 | 6/1989 | Frantz | 439/80 |
| 4,842,554 | 6/1989 | Cosmos et al. | 439/609 |
| 4,842,555 | 6/1989 | Cosmos et al. | 439/609 |
| 4,867,690 | 9/1989 | Thumma | 439/79 |
| 4,907,987 | 3/1990 | Douty et al. | 439/571 |
| 4,908,335 | 3/1990 | Cosmos et al. | 439/79 |
| 4,909,743 | 3/1990 | Johnson et al. | 439/60 |
| 4,946,400 | 8/1990 | Kawai et al. | 439/79 |
| 4,955,819 | 9/1990 | Harting et al. | 439/79 |
| 4,995,819 | 2/1991 | Ohl | 439/79 |
| 5,032,085 | 7/1991 | Alwine et al. | 439/79 |

*Primary Examiner*—Paula A. Bradley
*Attorney, Agent, or Firm*—David A. Smith

[57] ABSTRACT

There is disclosed a surface mount, circular DIN connector (10) with a housing (12) having a mating face (22) and a terminal receiving face (24). Three rows of terminal receiving cavities (1 to 8) open into the mating face (22) and the terminal receiving face (24). A set of electrical terminals (30) each has a mating portion (32) in a respective one of the cavities (1 to 8), a solder tail (36) extending substantially normally of the mating portion (32), and a connecting arm (38) connecting the mating portion (32) to the solder tail (36). The arms (38) are dimensioned relatively to offset the solder tails (36) with respect to the mating portions (32), in interleaved relationship to form a single row of solder tails (36) for soldering to respective contact pads arranged in a single row on a printed circuit board (20).

13 Claims, 10 Drawing Sheets

SURFACE MOUNT ELECTRICAL CONNECTOR WITH INTERLEAVED SOLDER TAILS

BACKGROUND OF THE INVENTION

This invention relates to a surface mount, right angle electrical connector, especially but not exclusively a surface mount right angle, circular DIN connector; having solder tails for soldering to contact pads on a circuit board. The invention also relates to an electrical terminal for such a connector. The invention pertains to connectors, which have three superposed rows of terminals from which the solder tails project.

U.S. Pat. No. 4,660,991 discloses an electrical connector comprising an insulating housing having two rows of terminal receiving cavities in each of which is lodged a mating portion of an electrical terminal from which projects from a terminal receiving face of the housing, and normally of the mating portion, a solder tail for soldering to a respective contact pad on a circuit board. The solder tails extend in a single row, the solder tails of the mating portions in the upper row of cavities being longer than those of the terminals received in the cavities of the lower row. U.S. Pat. No. 4,842,554, U.S. Pat. No. 4,842,555, U.S. Pat. No. 908,335 and U.S. Pat. No. 4,995,819 disclose a through-hole mount circular DIN connector having an insulating housing formed with three superposed rows of terminal receiving cavities, each cavity receiving a mating portion of a respective electrical terminal from which mating portion projects, normally thereof, a solder tail or leg for insertion in a respective hole in a circuit board or which the connector is mounted. The leg of each terminal is connected to the mating portion thereof, by way of a cranked arm which serves to offset the leg of the terminal from the mating portion thereof laterally of the housing. A spacer plate for the legs extends rearwardly from a terminal receiving face of the housing and is formed with rearwardly opening notches each for receiving two of the terminal legs so that these legs are arranged in two juxtaposed rows for insertion in two correspondingly arranged rows of holes in the circuit board. The arrangement of the legs in two rows, is achieved by appropriately cranking and appropriately dimensioning the arms of the terminals, taking account of the fact that the terminal receiving cavities are arranged in an unsymmetrical array. The cavities of the upper and the middle rows of the three rows of cavities are three in number, the cavities of the lower row being two in number. The cranked arms extend obliquely away from the terminal receiving face of the housing. The extent of offset of the legs with respect to the mating portions, is however sufficient for the purpose of arranging the legs in two rows. There is disclosed in U.S. Pat. No. 4,820,173, an electrical connector having a housing formed with three superposed rows of connector receiving cavities in each of which is a mating portion of an electrical terminal from which projects a solder tail substantially normally of the mating portion for soldering to a contact pad on a printed circuit board. The cavities are arranged in a symmetrical array, each cavity of each row being vertically aligned with two cavities of the other rows. The terminals of the connector are identical with each other excepting for the lengths of their solder tails and are canted in their cavities, in such a way that solder feet of the soldering tails are arranged in a single row.

SUMMARY OF THE INVENTION

The present invention is intended to provide a right angle surface mount electrical connector having three superposed rows of terminal receiving cavities, which may be arranged in an unsymmetrical array, each cavity containing a mating portion of an electrical terminal from which extends solder tail, the solder tails being interleaved so as to form a single row of solder tails for soldering to respective contact pads which are also arranged in a single row.

According to one aspect of the invention, a right angle electrical connector comprises an insulating housing having a mating forward face and a terminal receiving rearward face opposite thereto. The housing defines upper, middle and lower superposed rows of parallel terminal receiving cavities arranged in an unsymmetrical array and each opening into both the mating face and the terminal receiving face. The connector further comprises a set of electrical terminals each having a mating portion received and secured in a respective one of the cavities, a solder tail extending from the terminal receiving face substantially normally of the mating portion of the terminal and means extending normally of the solder tail and the mating portion and connecting the mating portion to the solder tail. The connecting means of the terminals are relatively dimensioned to offset the solder tails with respect to the mating portions in interleaved relationship to form a single row of solder tails, at least some of the connecting means extending laterally across the terminal receiving face and parallel thereto, to predetermined extents.

The connecting portions may be in the form of planar arms which extend at right angles to the mating portions of the terminals and thus parallel with the terminal receiving face.

Such connecting means are dimensioned to offset the solder tails from the mating portion of the terminals to the extent needed to interleave the solder tails, especially where the cavities are arranged in an unsymmetrical array.

According another aspect thereof, the invention is applied to a surface mount, circular DIN connector.

According to a further aspect of the invention, a one piece stamped and formed electrical terminal which is suitable for use with a connector according to the invention, comprises an elongate mating portion having a forward and a rear end, an elongate retention plate for retaining the mating portion in a cavity in an insulating housing and being axially aligned with the mating portion, the retention plate having one end connected to the rear end of the mating portion, a planar arm having one end connected to the other end of the retention plate and being coplanar therewith, the arm extending at right angles to the mating portion and the retention plate, and a solder tail having one end connected to the other end of the planar arm, the solder tail depending from the other end of the planar arm substantially normally of the planar arm to a distal end and the distal end of the solder tail being formed with a solder foot.

The connector may comprise a solder tail spacer plate projecting from the terminal receiving face below the rows of cavities and having rearwardly opening notches for receiving the solder tails. Each solder tail of each terminal may be angled with respect to the arm and the retention plate so that when the mating portion of the terminal is inserted into its cavity, the solder tail is urged against the base of a respective notch in the retention plate.

DESCRIPTION OF THE PREFERRED EMBODIMENT

Figure 1:
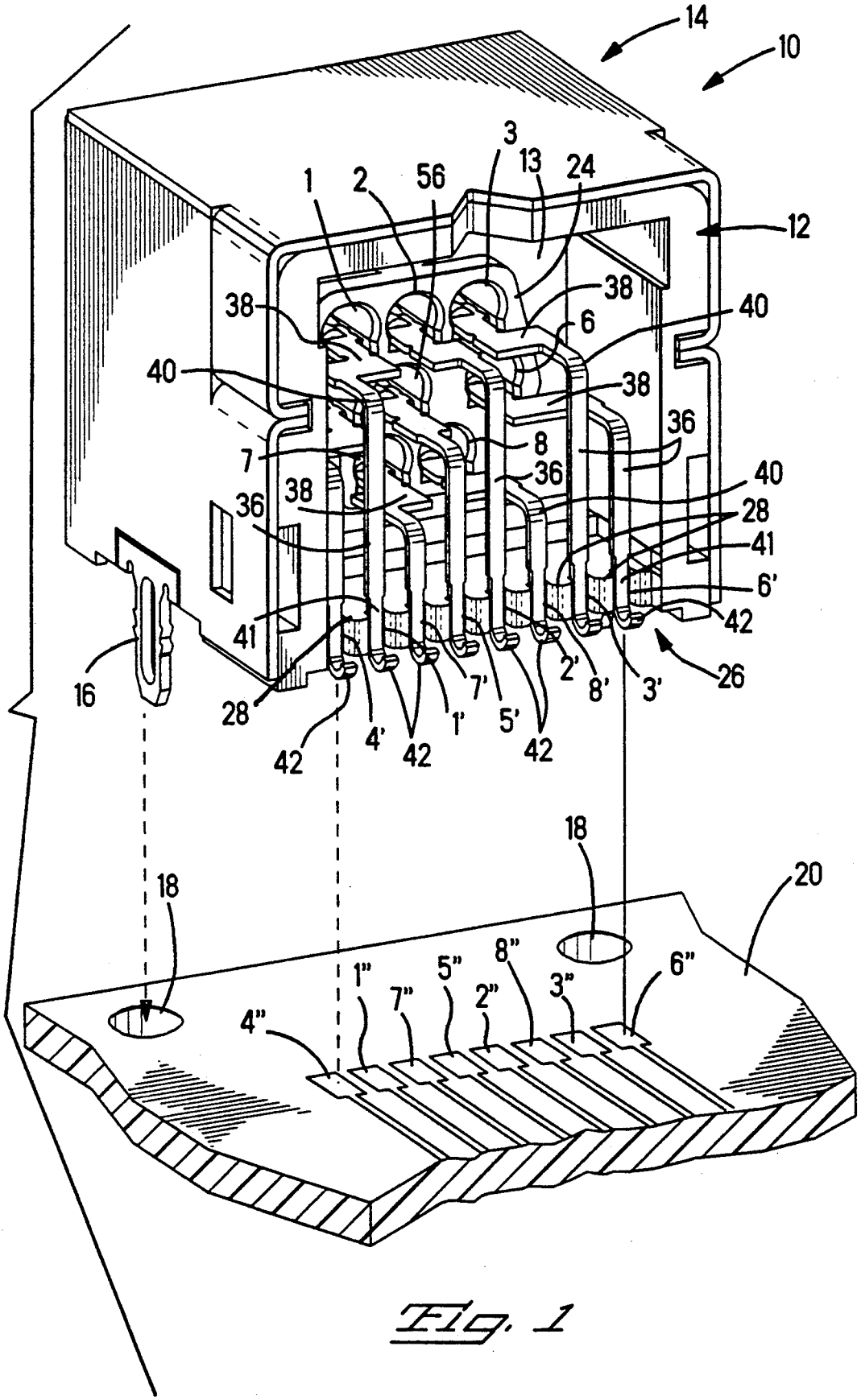
FIG. 1 is an isometric view taken from the rear, of a surface mount, shielded, eight position, circular DIN electrical right angle connector exploded from a circuit board, the connector comprising an insulating housing, a metal shield thereabout and three superposed rows of cavities each receiving electrical terminals.

With reference to FIGS. 1 to 5, a surface mount, shielded eight position, circular DIN, electrical right angle connector 10 comprises a one piece molded insulating housing 12 constructed basically according to the teaching of U.S. Pat. No. 4,908,335 which is incorporated herein by reference, and a metal shield 14 enclosing the housing 12 and which is constructed basically according to the teaching of U.S. Pat. No. 4,842,554 which is incorporated herein by reference. A substantially rectangular body 13 of the housing 12 is provided with board locks 16 depending from opposite side walls thereof for locking in insertion in holes 18 of circuit board 20 to secure the connector 10 thereto. The housing 12 has extending axially through an elongate, circular cross section plug portion 15 thereof, formed integrally with the body 13, three substantially equally spaced parallel rows of parallel, terminal receiving cavities referenced 1 to 8, respectively. The cavities 1 to 8 are arranged in an unsymmetrical array, the top row consisting of cavities 1 to 3, the middle row consisting of cavities 4, 5 and 6 and the bottom row consisting of cavities 7 and 8. The cavities 1, 2 and 3 of the top row are evenly spaced from each other, the cavities 4 and 5 of the middle row being, however, are laterally offset from those of the top row with the cavity 6 being laterally spaced more widely from the cavity 5 than the cavity 5 is spaced from the cavity 4. The cavities 7 and 8 are closely spaced from each other and are laterally offset from each of the cavities 1 to 6. Each cavity 1 to 8 opens both into a forward mating face 22 of the plug portion 15 and into a rear terminal receiving face 24 of the body. There projects rearwardly from the body 13, below the terminal receiving face 24, a solder tail positioning and spacer plate 26 formed with ribs 28 defining a row of eight evenly spaced solder tail receiving notches identified by reference numerals below opening rearwardly of the plate 26. An analogous spacer plate disclosed in U.S. Pat. No. 4,908,335 has notches dimensioned and configured to receive, in each notch, a plurality of legs projecting from terminals in the housing. Each notch of the spacer plate 26, is, however, according to the present invention, dimensioned to receive only a single solder tail as will be described below. The notches of the plate 26, are referenced, as seen from left to right in FIGS. 1, 2 and 4; 4', 1', 7', 5', 2', 8', 3' and 6', respectively. Each of the notches has a vertical base 27, the bases 27 of all the notches being in the same plane. Standoffs 29 or bottom wall 31 of the body 13 provide for flushing beneath the housing as is known in the art.

The preferred embodiment of connector 2 further comprises eight one piece stamped and formed electrical terminals 30 each comprising a forward mating part in the form of a receptacle 32 according to the teaching, of U.S. Pat. No. 4,776,651 which is incorporated herein by reference. There is connected to the rear end of the receptacle 32, an elongate insertion and retention plate 34 having retention barbs 37 (FIGS. 16 to 23) for retaining the terminal 30 in its cavity and an insertion hump 39, according to the teaching of U.S. Pat. No. 4,908,335 which is also incorporated herein by reference. The plate 34 is axially aligned with the receptacle 32. According to the invention, a resilient solder tail 36 is connected to the rear end of the plate 34 by way of a planar connecting arm 38 extending at right angles to the plate 34 and in the plane thereof, the solder tail 36 being connected to the end of the arm 38 remote from the plate 34 by way of a bight 40 so that the solder tail 36 depends substantially normally with respect to the plate 34, the arm 38, and the receptacle 32. Each solder tail in the preferred embodiment 36 terminates in a reduced width portion 41 formed at its free end with a hookshaped, arcuate, soldering foot 42 projecting laterally in a direction away from the receptacle 32 and having a smoothly arcuate contact surface 44 bowed away from the arm 38. The solder tail could terminate in any known surface mount design such as a butt joint or gullwing.

The receptacle 32 and the plate 34 of each terminal 30 are received in a respective one of the cavities 1 to 8 of the housing 12 with the portion 41 of the contact tail 36 received in a respective one of the notches defined by the ribs 28.

Figure 2:
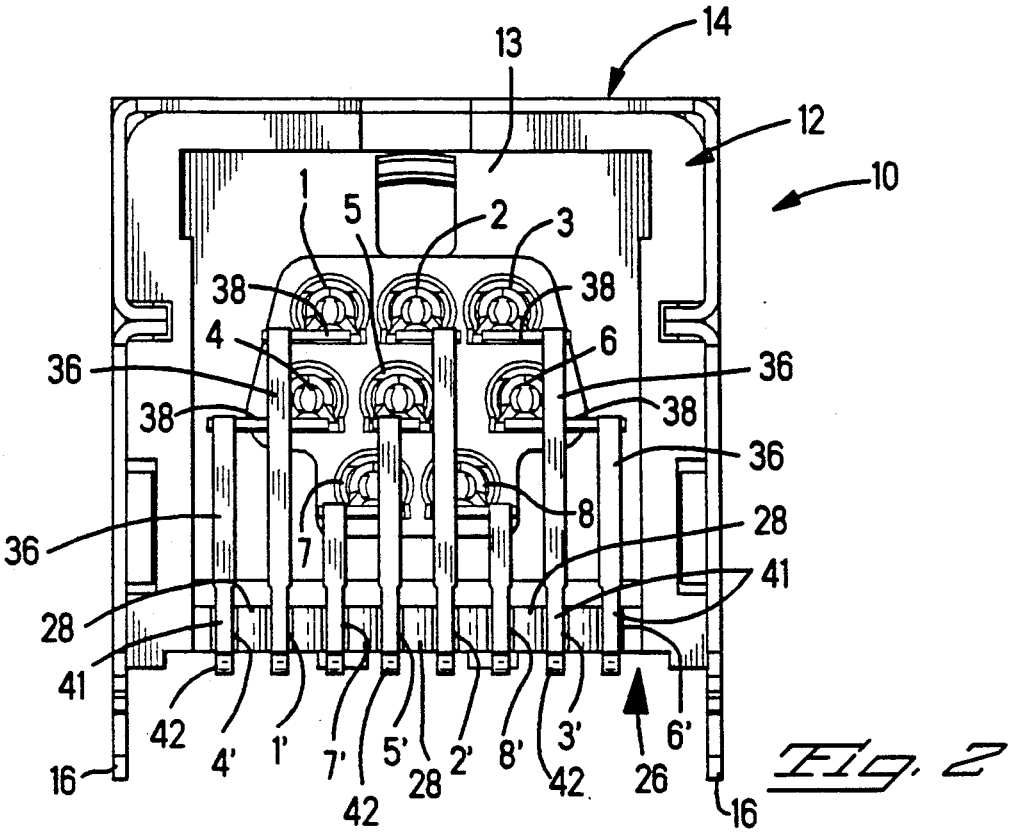
FIG. 2 is a rear view of the connector.
Figure 3:
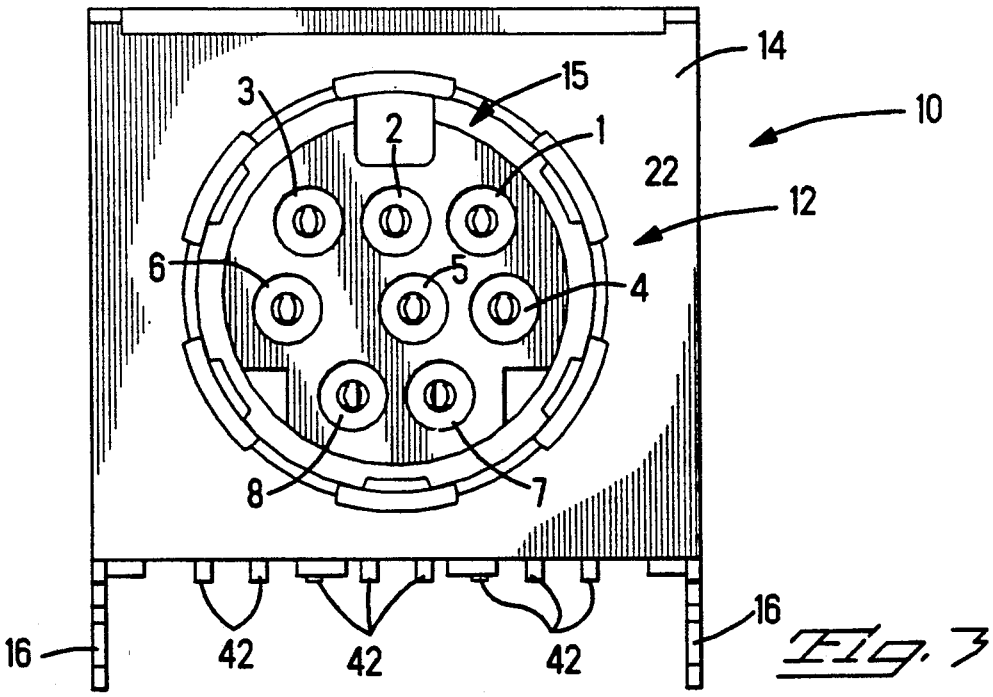
FIG. 3 is a front view of the connector.
Figure 4:
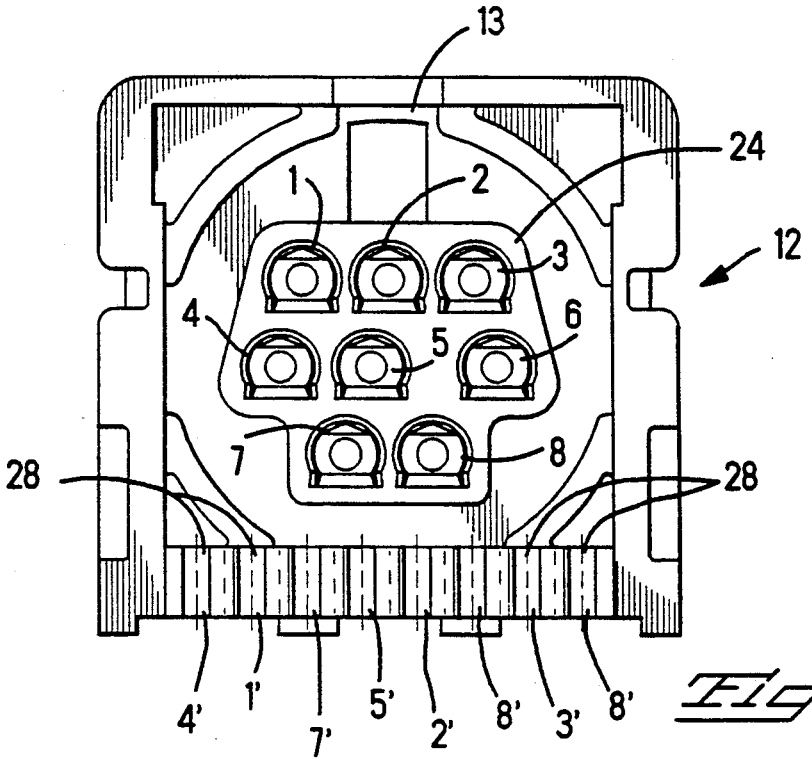
FIG. 4 is a rear view of the housing of the connector.
Figure 5:
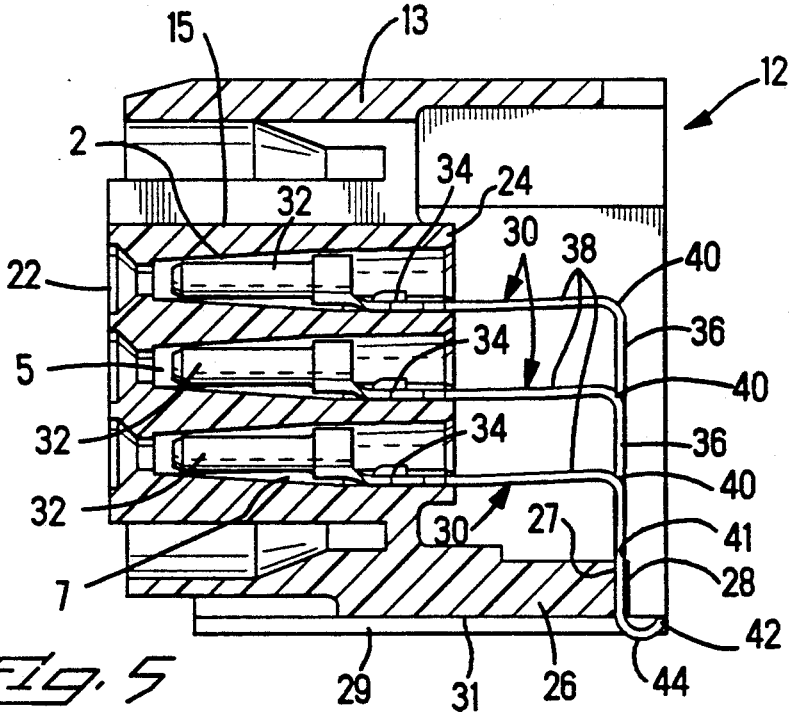
FIG. 5 is a sectional side view of the housing with the terminals loaded into the cavities.

The circuit board 20 has, on its upper surface, a single row of eight spaced contact pads, which are referenced as seen from left to right in FIG. 1, 4", 1", 7", 5", 2", 8", 3" and 6", respectively, to which pads, the solder feet 42 of the terminals 30 in the respective cavities 4, 1, 7, 5, 2, 8, 3 and 6, are to be soldered for the provision of a desired circuit arrangement for connection to leads connected to a socket connector (not shown) for mating with the plug portion 15. The reduced width portions 41 of the solder tails 36 of the terminals 30 in the cavities 4, 1, 7, 5, 2, 8, 3 and 6 are received in the notches 4', 1', 7', 5', 2", 8', 3', 6", respectively, as shown in FIGS. 1 and 2, so that the appropriate solder foot 42 can be soldered to the appropriate contact pad on the board 20 when the board locks 16 have been pushed home into the holes 18 in the board 20 so that the connector 2 is mounted on board 20 with standoffs 29 engaging the upper surface of the board. The arm 38 of each terminal 30 must, therefore, be of appropriate length and direction and the solder tail 36 thereon must be of appropriate length, in order to ensure that the portion 41 of the solder tail 36 can be received in the correct notch in the spacer plate 26, without the danger of short circuiting between the terminals 30 and with assurance that solder foot 42 is positioned for receipt against a respective pad upon mounting connector 2 on board 20.

FIGS. 16 to 23 show the length and the direction of the connecting arms 28 of the terminals 30 in the cavities 1 to 8 respectively, and such dimensions will also be apparent from FIGS. 1 and 2. It will be appreciated, with particular reference to FIGS. 16 to 23, that the arms 38 of the terminals 30 in the two end cavities 1 and 3 of the top row extend in opposite directions and are of substantially the same length (FIGS. 16 to 18), the arm 38 of the terminal 30 in the middle cavity 2 of the top row (FIG. 17) extending in the same direction as the arm 38 shown in FIG. 18, but being shorter than that arm. The arms 38 of the terminals 30 in the two end cavities 4 and 6 of the middle row (FIGS. 19 to 21) extend in opposite directions and are substantially longer than those of the terminals 30 in the cavities 1 and 3, while the arm 38 of the terminal in the cavity 5 (FIG. 20) extends in the same direction as the arms 38 of the terminals 30 in the cavities 1 and 4 (FIGS. 16 and 19) but is shorter than any of the other arms 38. The arms 38 of the terminals 30 in the cavities 7 and 8 in the bottom row (FIGS. 22 and 23) extend in opposite directions and are of substantially the same length in each case, as the arms 38 of the terminals 30 in the cavities 1 and 3. The only solder tails 36 which are offset beyond the confines of the face 24 are those of the terminals of the cavities 4 and 6.

As best seen in FIG. 2, the solder tails 36 of the terminals 30 in the cavities of the top row are the longest and are of equal length, the solder tails 36 of the terminals 30 in the cavities of the middle row also being of equal length but being shorter than the contact tails of the terminals in cavities of the top row. The solder tails 36 of the terminals 30 in the bottom row are also of equal length but are shorter than those of the terminals 30 in the cavities of the middle row. The retention plates 34 are all of the same length.

Figure 6:
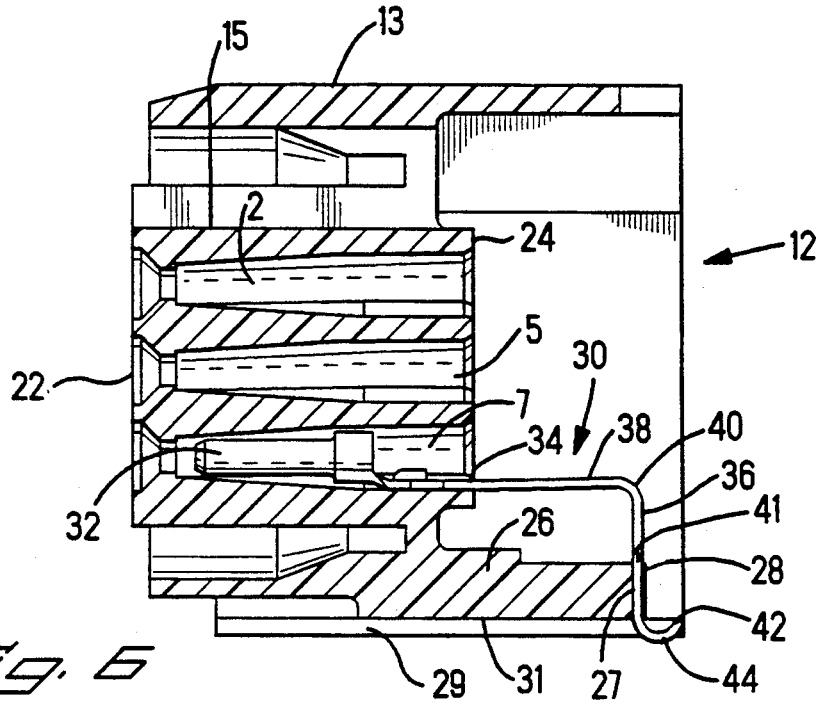
FIG. 6 is a similar view to that of FIG. 5 but with terminals loaded only into the bottom row of cavities.
Figure 8:
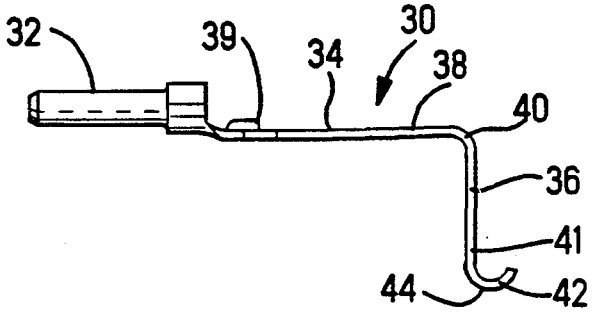
FIG. 8 is a side view of the terminal of FIG. 7 showing the configuration thereof after it has been loaded into the housing.
Figure 9:
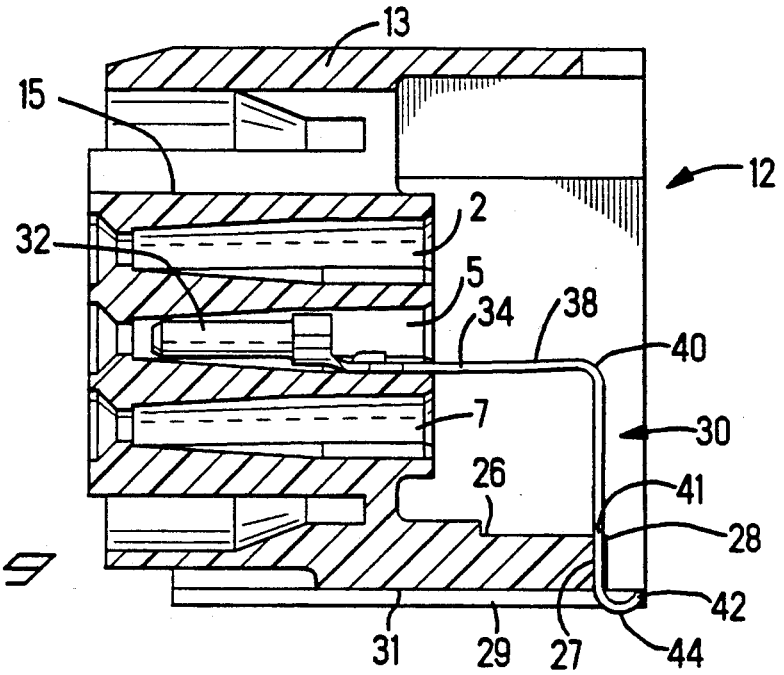
FIG. 9 is a similar view to that of FIG. 6 with terminals loaded into the middle row of cavities, but not showing, in the interest of clarity, the terminals loaded into the cavities of the bottom row.
Figure 11:
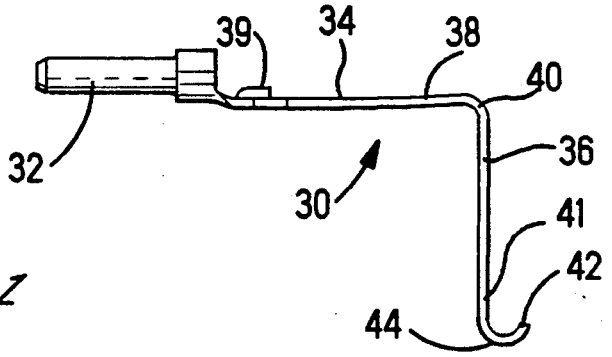
FIG. 11 is a side view of the terminal of FIG. 10, showing the configuration thereof after it has been loaded into the housing.
Figure 12:
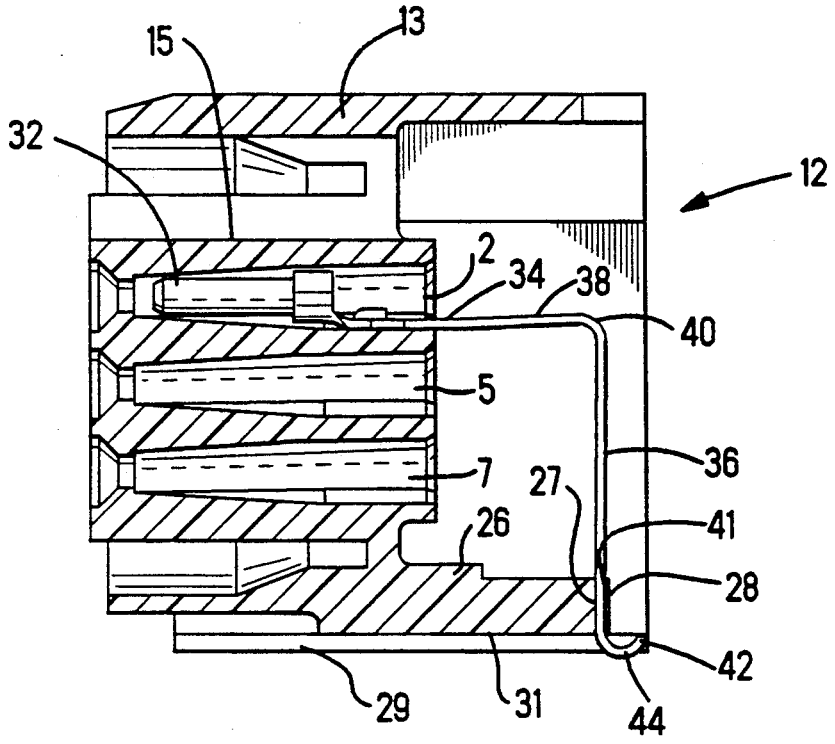
FIG. 12 is a similar view to that of FIG. 6 but with the terminals loaded into the cavities of the top row, the terminals in the bottom and the middle rows not being shown in the interest of clarity.

The manner in which the terminals 30 are loaded into the housing 12 will now be described with reference to FIGS. 6 to 15. As shown in FIGS. 6, 9 and 12, respectively, terminals 30 of the bottom row are first loaded into the cavities 7 and 8, the terminals 30 of the middle row are then loaded into the cavities 4, 5 and 6 and the terminals 30 of the top row are loaded into the cavities 1, 2 and 3. By virtue of this order of loading the bottom, the middle and the top rows of cavities successively, damage to and tangling of, the solder tails 36 is avoided.

Figure 7:
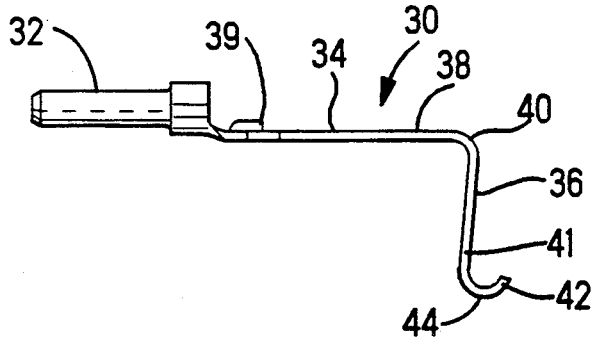
FIG. 7 is a side view of a terminal adapted to be received in the bottom row of terminal receiving cavities showing its configuration before it has been loaded into the housing.
Figure 10:
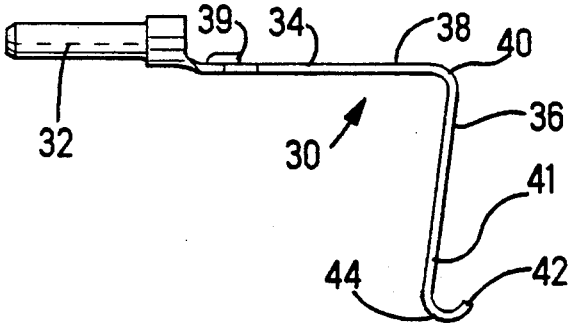
FIG. 10 is a side view of a terminal adapted to be received in the middle row showing the configuration thereof before it has been loaded into the housing.
Figure 13:
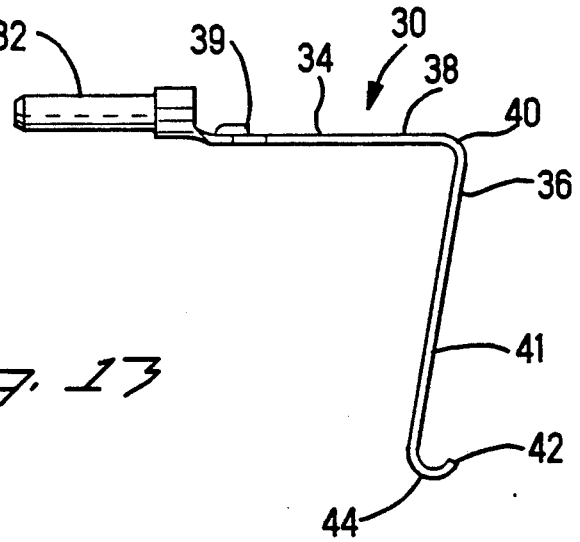
FIG. 13 is a side view of a terminal adapted to be received in the top row showing the configuration thereof before it has been loaded into the housing.
Figure 14:
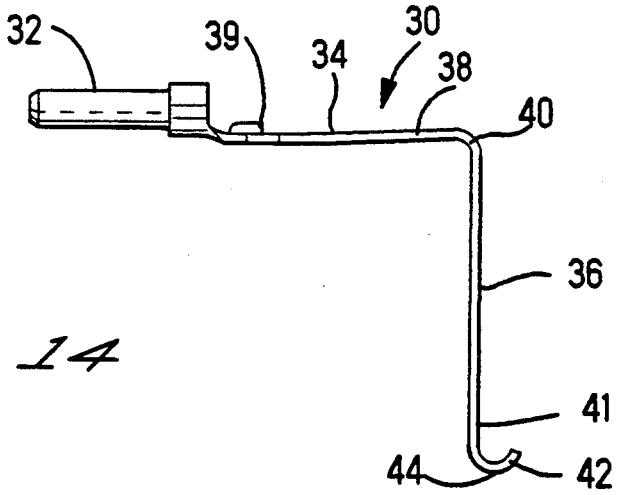
FIG. 14 is a side view of the terminal of FIG. 13 showing the configuration thereof after it has been loaded into the housing.
Figure 15:
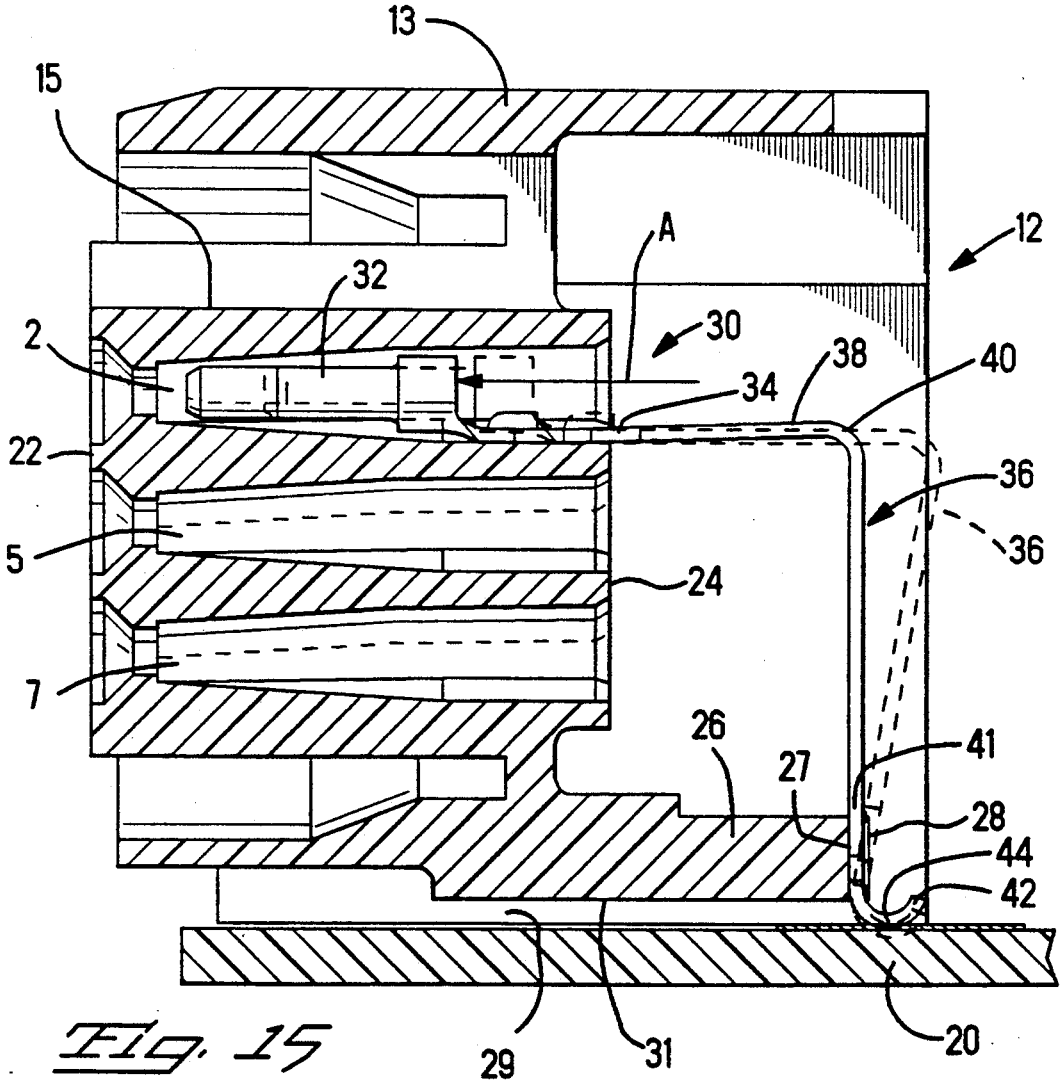
FIG. 15 is an enlarged view similar to that of FIG. 12 but showing the housing mounted on a circuit board.
Figure 16:
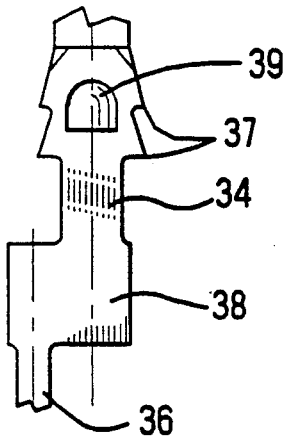
FIGS. 16 to 23 are fragmentary plan views illustrating details of the terminals of respective ones of the eight cavities of the housing.
Figure 17:
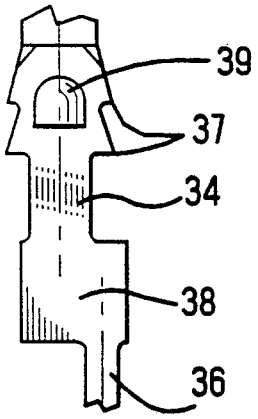
Figure 18:
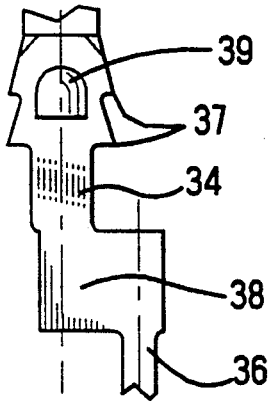
Figure 19:
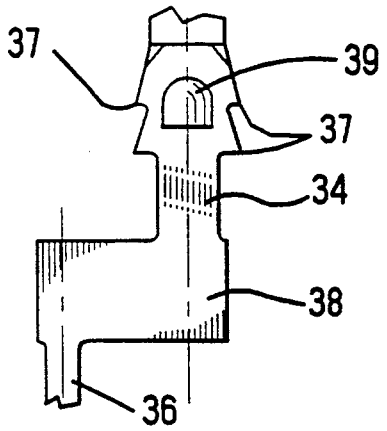
Figure 20:
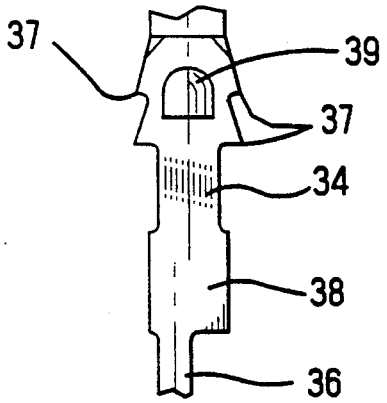
Figure 21:
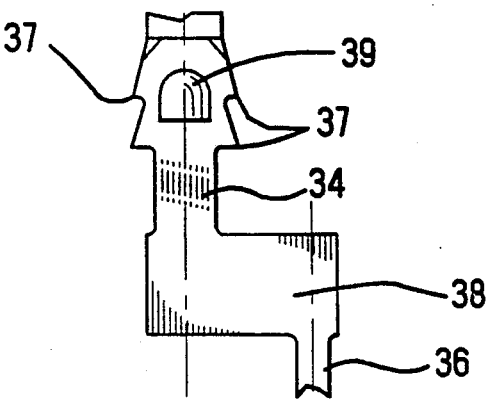
Figure 22:
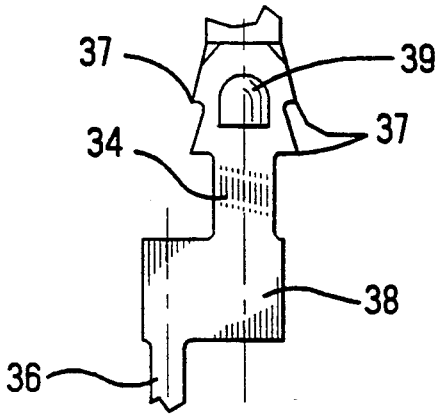
Figure 23:
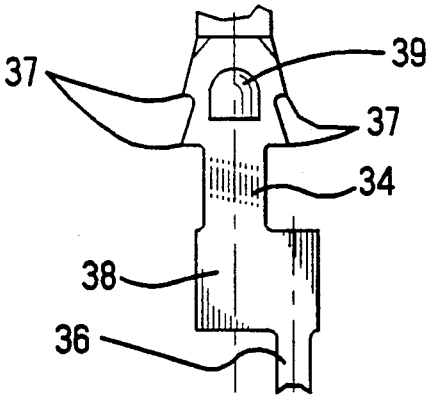

As shown in FIGS. 7, 10 and 13, the solder tail or contact tail 36 of each terminal 30 before the terminal is loaded into the housing, is acutely angled slightly in the insertion direction of receptacle 32, with respect to the plane of the plate 34. As shown in FIGS. 8, 11 and 30, the contact tail 36 extends substantially at a right angle to said plane after the receptacle 32 has been loaded into its respective cavity. Each terminal 30 is loaded into the housing 12, with the receptacle 32 thereof leading, so that the barbs 37 of the plate 34 bite into the wall of the respective cavity to retain the receptacle therein. The insertion hump 39, acts, in known manner as an abutment for a tool (not shown) for inserting the receptacle into the cavity. As each terminal is being loaded into the housing 12, the contact tail of each terminal moves vertically upward (as best seen in FIGS. 8, 9, 11, 12, 14 and 15) resulting in a slight upward bow in arm 38. Also, the reduced width portion 41 of the solder tail 36 thereof is inserted into the appropriate notch in the spacer plate 26, until it butts against the base 27 of the notch, as shown in FIGS. 6, 9, 12 and 15. Since the solder tail 36 is forced resiliently, about its bight 40, from its initial acute angled position, into the position normal to the plate 34, by the abutment of the portion 41 against the base 27 of the notch, the portion 41 is urged by the resilient action of the bight 40 against base 27 into a firmly seated position in the notch, the arm 38 being slightly bowed as shown in FIGS. 5, 6, 9, 12 and 15. FIG. 15 shows in broken lines, the position of the solder tail 36 as portion 41 begins to engage between a respective adjacent pair of the ribs 28. In said firmly seated position of each solder tail 36, the contact surface 44 of its solder foot 42 projects slightly below the bottom of the connector that engages the top surface of the circuit board, in this case the bottom of standoffs 29. Thus when the housing 12 has been mounted to the circuit board 20, the solder foot 42 is firmly and resiliently pressed against the respective solder pad on the board 20 by virtue of the resilience of the arm 38. The solder feet 42 are then correctly located for soldering to the respective pads on the circuit board 20.

By virtue of the invention, a right angle electrical connector (which need not be a circular DIN connector and need not be shielded) having three superposed rows of terminals has solder tails thereof interleaved to form a single row, for soldering to a single row of contacts. Also, the contact feet of the contact tails are firmly retained in position for application to said contacts.

The unsymmetrical arrangement of the terminal receiving cavities is compensated for by virtue of the relative dimensioning of the means, namely the arms 38, for offsetting the solder tails 36 from the receptacles 32, all of the arms 38 extending laterally of the terminal receiving face 24 and parallel thereto. Some of the arms 38, namely those associated with the cavities 1, 3, 4, 6, 7 and 8, extend beyond these cavities so as to extend across the face 24 in overlapping relationship therewith. The arms 38 associated with each row of cavities are, at least in the preferred embodiment described herein, coplanar with each other and the arms 38 associated with each row of cavities are parallel with the arms 38 associated with the other two rows.

I claim:

1. A right angle electrical connector comprising;

an insulating housing having a mating forward face and a terminal receiving face opposite thereto, the housing defining upper, middle and lower superposed rows of parallel terminal receiving cavities arranged in an unsymmetrical array and each opening into both of said faces; and a set of electrical terminals each having a mating portion lodged in a respective one of said cavities, a solder tail extending from the terminal receiving face substantially normally of the mating portion of the terminal, and portions extending normally of the solder tail and the mating portion and connecting the mating portion to the solder tail, the connecting portions of the terminals being dimensioned relatively to offset the solder tails thereof with respect to the mating portions thereof, in interleaved relationship to form a single row of solder tails, at least some of said connecting portions extending laterally across the terminal receiving face and parallel thereto, to predetermined extents.

2. A connector as claimed in claim 1, wherein each connecting portions is in the form of a planar arm, one end of which is connected to a plate projecting from the mating portion of the terminal outwardly from the terminal receiving face, the solder tail of the terminal being connected to the other end of the arm, the arm being coplanar with said plate and extending therefrom at right angles with respect thereto.

3. A connector as claimed in claim 1, wherein the connecting portions of the terminals in the end cavities of the upper row of cavities offset the solder tails of these terminals to a first extent and within the confines of the terminal receiving face, the connecting means of the terminals in the end cavities of the middle row thereof, offsetting those terminals in opposite directions to a second extent beyond the confines of the terminal receiving face.

4. A connector as claimed in claim 3, wherein the upper row of cavities comprises three constantly spaced cavities, the middle row of cavities comprising two adjacent cavities and a third cavity remote from said two adjacent cavities, the lower row of cavities comprising two adjacent cavities, the connecting portions of the terminals in the cavities of the bottom row offsetting the solder tails of these terminals in opposite directions across the terminal receiving face, the connecting means of the terminal in the middle cavity of the top row of cavities offsetting the solder tail of that terminal across the terminal receiving face, to a lesser extent than the connecting means of the terminals in the two outer cavities of the top row of the cavities and the connecting means of the terminal in the middle cavity of the middle row of cavities offsetting the solder tail of that terminal from the mating portion thereof, to a lesser extent than the connecting means of the terminals in any other of the cavities offset the solder tails of those terminals from the mating portions thereof.

5. A connector as claimed in claim 1, wherein the housing comprises a solder tail spacer plate projecting rearwardly from a terminal receiving face below the bottom row of cavities, the spacer plate defining a single row of rearwardly opening notches of equal depth, each receiving a portion of a respective one of the solder tails, each solder tail having a solder foot having a contact surface projecting beneath the spacer plate.

6. A connector as claimed in claim 5, wherein a retention plate projects from the mating portion of each terminal so as to extend from the terminal receiving face, the connecting portions of the terminal being in the form of an arm one end of which is connected to the retention plate and the other end of which is connected to the solder tail of the terminal, said solder tails being resiliently urged against the base of the respective notch in the spacer plate and the contact surface of the solder tail being moveable toward the spacer plate against the resilient action of the arm.

7. A connector as claimed in claim 6, wherein the contact surface of the solder foot of the solder tails extend to be coplanar.

8. A surface mount, circular DIN right angle connector comprising;

a one piece molded insulating housing having a circular cross section elongate plug portion having at one end thereof a mating face, three superposed rows of terminal receiving parallel cavities extending through the plug portion axially thereof, a rectangular cross section body formed integrally with the other end of the plug portion and being provided with means for securing the body to a circuit board with a bottom wall of the body thereagainst, the said body having a terminal receiving face opposite to said mating face, each of said cavities extending through the body and opening into said terminal receiving face, the cavities being arranged in upper, middle and lower, superposed rows of cavities; and a set of electrical terminals each having a mating portion in a respective one of said cavities, a solder tail extending from the terminal receiving face substantially normally of the mating portion of the terminal and having a solder foot projecting below the bottom wall of said body, and portions connecting the mating portion of the terminal to the contact tail thereof, the connecting portions means of the terminals being relatively dimensioned, relatively to offset said solder tails with respect to said mating portions in interleaved relationship to form a single row of solder tails each having a respective solder foot projecting below said bottom wall of the body for engaging respective contact pads of a single row of contact pads on said circuit board.

9. A connector as claimed in claim 8, wherein the connecting portion of each terminal extends at right angles to the mating portion thereof and parallel to the terminal receiving face.

10. A connector as claimed in claim 8, wherein the connecting portion of the terminals of each row are parallel to the connecting portion of the terminals of the other rows and some of the solder tails are offset by their connecting portion, beyond the confines of the terminal receiving face.

11. A connector as claimed in claim 8, wherein the connecting portion of each terminal is in the form of a planar arm, one end of which is connected to a retention plate for retaining the terminal in its cavity, the other end of the arm being connected to the solder tail of the terminal, the plate and the arm being coplanar and the arm extending from the plate at right angles with respect to the plate and the mating portion of the terminal.

12. A connector as claimed in claim 8, wherein the cavities are arranged in an unsymmetrical array, the connecting portion of each terminal extending at right angles to the mating portion thereof and parallel to the terminal receiving face and at least some of the connecting portions overlapping the terminal receiving face.

13. A connector as claimed in claim 8, comprising a solder tail spacer plate projecting from said body below the terminal receiving face thereof, the spacer plate defining a single row of notches of equal depth opening in a direction away from the terminal receiving face and each receiving a portion of a respective one of the solder tails, the contact surface of the solder foot of each solder tail projecting beneath the spacer plate.

* * * * *